US009440347B1

(12) United States Patent
Lopez

(10) Patent No.: US 9,440,347 B1
(45) Date of Patent: Sep. 13, 2016

(54) TOOL IMPLEMENT WITH INTEGRATED STAKE PULLER

(71) Applicant: James Lopez, Tome, NM (US)

(72) Inventor: James Lopez, Tome, NM (US)

( * ) Notice: Subject to any disclaimer, the term of this patent is extended or adjusted under 35 U.S.C. 154(b) by 460 days.

(21) Appl. No.: 13/975,832

(22) Filed: Aug. 26, 2013

(51) Int. Cl.
*B25F 1/00* (2006.01)

(52) U.S. Cl.
CPC *B25F 1/006* (2013.01); *B25F 1/00* (2013.01)

(58) Field of Classification Search
CPC ..... B25F 1/006; B25F 1/00; B25D 1/00; B25D 1/04
See application file for complete search history.

(56) References Cited

U.S. PATENT DOCUMENTS 1,479,741 A * 1/1924 Reitz ..... B25F 1/00 7/147
3,823,430 A 7/1974 Welsh, II et al.
3,867,733 A 2/1975 Verlander
4,112,530 A 9/1978 Lecce et al.
4,597,123 A * 7/1986 Cobe, Jr. ..... B25C 11/00 7/138
5,237,715 A * 8/1993 Bane, III ..... B25F 1/006 7/139
6,460,210 B1 * 10/2002 Alpert ..... B25C 11/00 7/144
6,634,047 B2 10/2003 Rowland
7,367,545 B1 * 5/2008 Chen ..... B25C 11/00 254/21
2007/0226913 A1 * 10/2007 Woolley ..... B25F 1/00 7/146

* cited by examiner

*Primary Examiner* — Robert Scruggs
(74) *Attorney, Agent, or Firm* — Crossley & Stevenson Intellectual Property Law

(57) ABSTRACT

A tool implement with integrated stake puller providing a working tool and a stake puller member for pulling a concrete foundation stake from the ground. A tool implement, such as a hammer, a crowbar, or a mallet, forms a primary body including a handle and a tool head being a respective hammerhead, head of a crowbar, and mallet head. A C-shaped stake puller member is disposed in one of a first position and a second position on the handle and, alternately in a third position on the tool head depending on the type of tool head. Each stake puller member has a puller mouth including a smooth-surfaced inner side, concave top and bottom sections disposed on opposite sides of the inner side, and disposed on each of the top section and the bottom section in a position parallel to each other and perpendicular to the respective handle and alternately tool head.

1 Claim, 5 Drawing Sheets

TOOL IMPLEMENT WITH INTEGRATED STAKE PULLER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of stake driver and removal tools are known in the prior art. However, what is needed is a tool implement with integrated stake puller providing a working tool, including a hammer, a crow bar, or a mallet, in combination with a stake puller member having a toothed puller mouth for pulling a concrete foundation stake from the ground.

FIELD OF THE INVENTION

The present invention relates to stake driver and removal tools, and more particularly, to a tool implement with integrated stake puller.

SUMMARY OF THE INVENTION

The general purpose of the present tool implement with integrated stake puller, described subsequently in greater detail, is to provide a tool implement with integrated stake puller which has many novel features that result in a tool implement with integrated stake puller which is not anticipated, rendered obvious, suggested, or even implied by prior art, either alone or in combination thereof.

To accomplish this, the present tool implement with integrated stake puller includes a tool implement, such as a hammer, a crowbar, or a mallet, including a handle and a tool head, which is a respective one of a hammerhead, a head of a crowbar, and a mallet head.

A C-shaped stake puller member is disposed in one of a first position and a second position on the handle and, alternately in a third position on the tool head depending on the type of tool head. Each stake puller member has a puller mouth including a smooth-surfaced inner side, concave top and bottom sections disposed on opposite sides of the inner side, and disposed on each of the top section and the bottom section in a position parallel to each other and perpendicular to the respective handle and alternately tool head. The stake puller member is disposed in the first position, the second position, or the third position upon the tool head type being a hammerhead, a head of a crowbar, and a mallet head, respectively, so that each of the tool head and the stake puller member can be used independently of the other for the particular work to be performed.

The stake puller member in the first position is centrally disposed in a neck of the handle and is perpendicular to the tool head. In the first position, the stake puller member has a continuous convex C-shaped outer wall and a pair of diametrically opposed C-shaped side walls. The outer wall has a top portion and a bottom portion. The stake puller member in the first position further has a U-shaped apex of the top portion of the outer wall with the apex conforming to a horizontal axis of the neck. The stake puller member in the first position has a C-shaped toothed puller mouth disposed therein in a position opposite to and conforming to the C-shaped outer wall. The stake puller member in the second position is integrally disposed on the handle proximal a proximal end thereof. The C-shaped stake puller member in the second position has a top wall and a bottom wall angled toward each other and an inner wall, which constitutes a portion of the handle between the top wall and the bottom wall. A pair of diametrically opposed triangular side edges is disposed on each side of each of the top wall and the bottom wall. In the second position, the stake puller member includes a C-shaped puller mouth defined by the inner wall, the top wall, the bottom wall and the side edges. The stake puller member in the third position is integrally disposed on the tool head and has an upper wall and a lower wall angled toward each other as well as an inside wall, which is a portion of the handle between the upper wall and the lower wall. A pair of diametrically opposed triangular outside walls is disposed on each of a side of each of the upper wall and the lower wall.

A C-shaped toothed puller mouth is defined by the inside wall, the upper wall, the lower wall and the outside walls of the stake puller member in the third position. The puller mouth of each of the puller members in a respective first, second and third position has a smooth-surfaced inner side in a position parallel to the respective handle and alternately tool head. The puller mouth also has a concave top section and a concave bottom section disposed on opposite sides of the inner side. A plurality of ridges is disposed on each of the top section and the bottom section in a position parallel to each other and perpendicular to the respective handle and alternately tool head. The puller mouth is configured and sized to securingly engage and remove a concrete foundation stake from a ground surface.

Thus has been broadly outlined the more important features of the present tool implement with integrated stake puller so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

With reference now to the drawings, and in particular FIGS. 1 through 6 thereof, an example of the instant tool implement with integrated stake puller employing the principles and concepts of the present tool implement with integrated stake puller and generally designated by the reference number 10 will be described.

Figure 1:
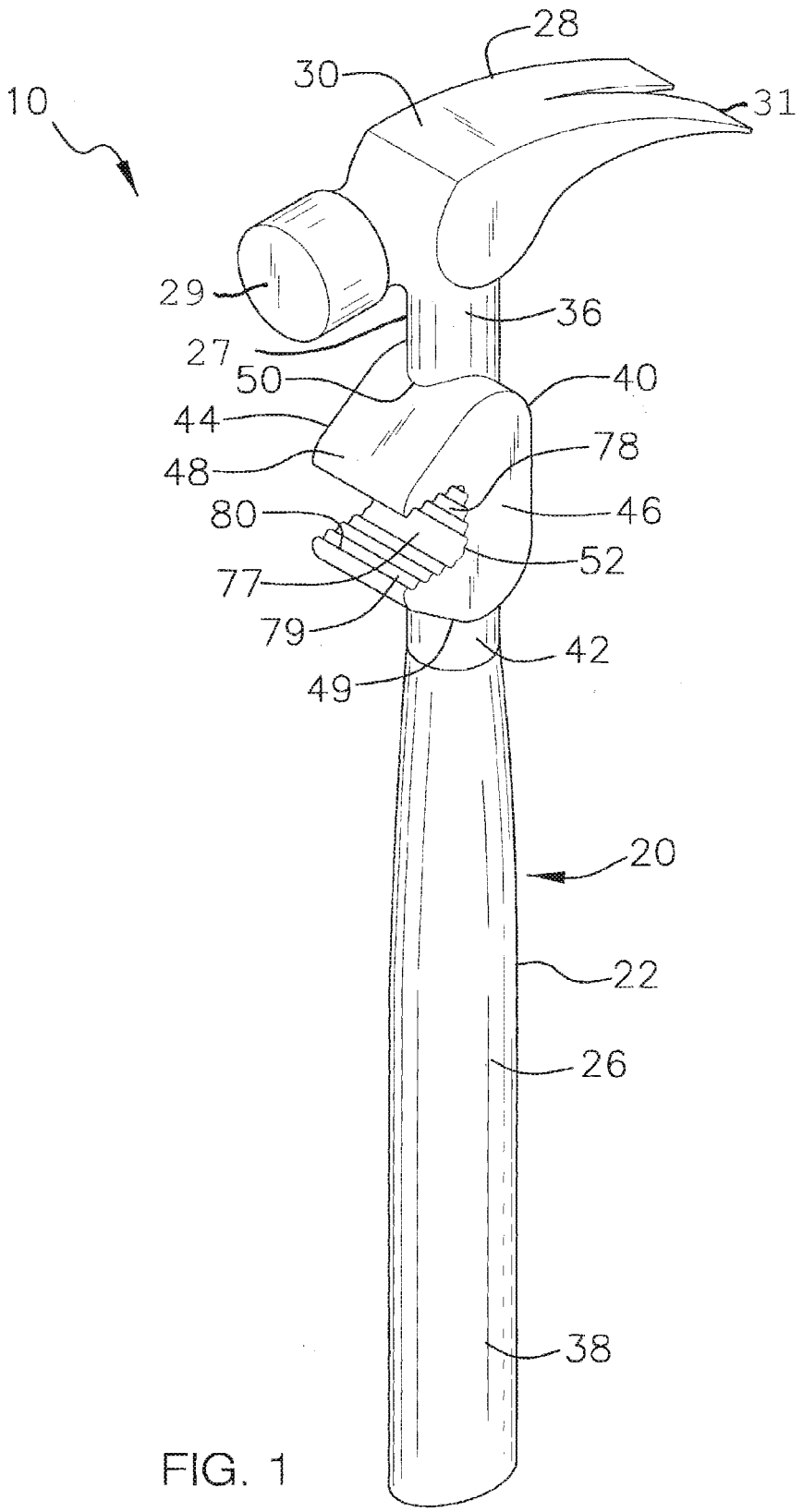
FIG. 1 is an isometric view showing a stake puller disposed on a tool implement in the form of a hammer.
Figure 2:
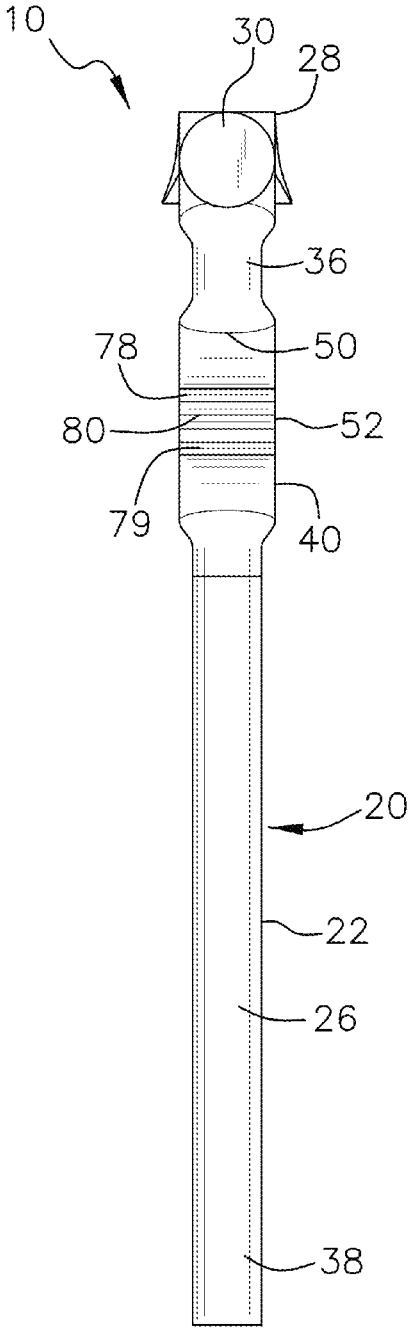
FIG. 2 is a front elevation view.
Figure 3:
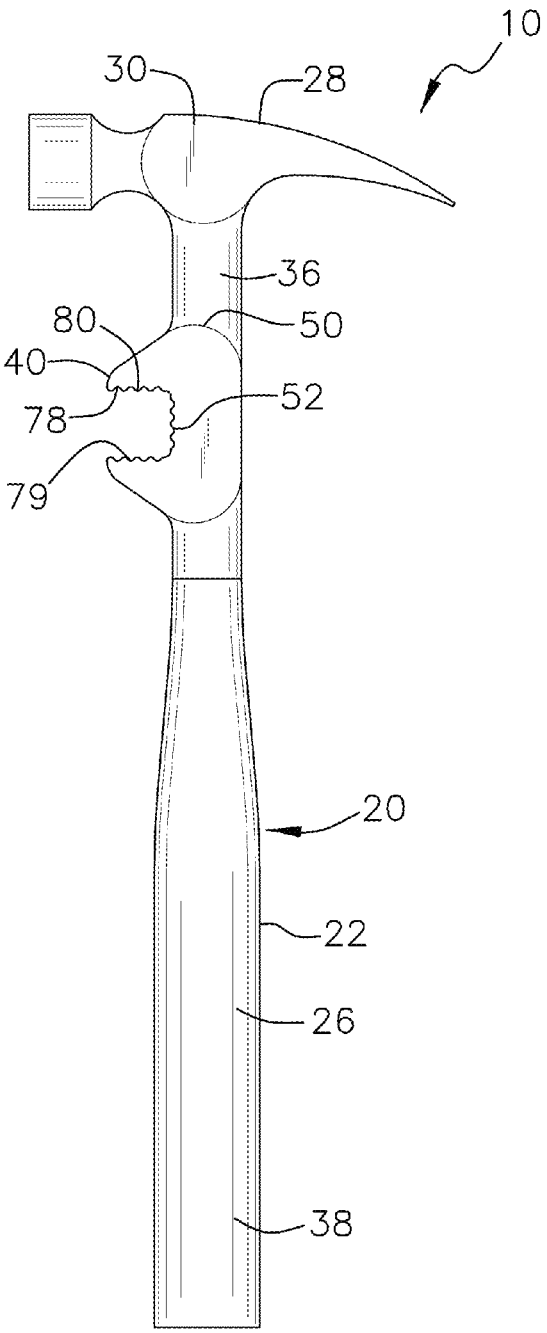
FIG. 3 is a side elevation view.
Figure 4:
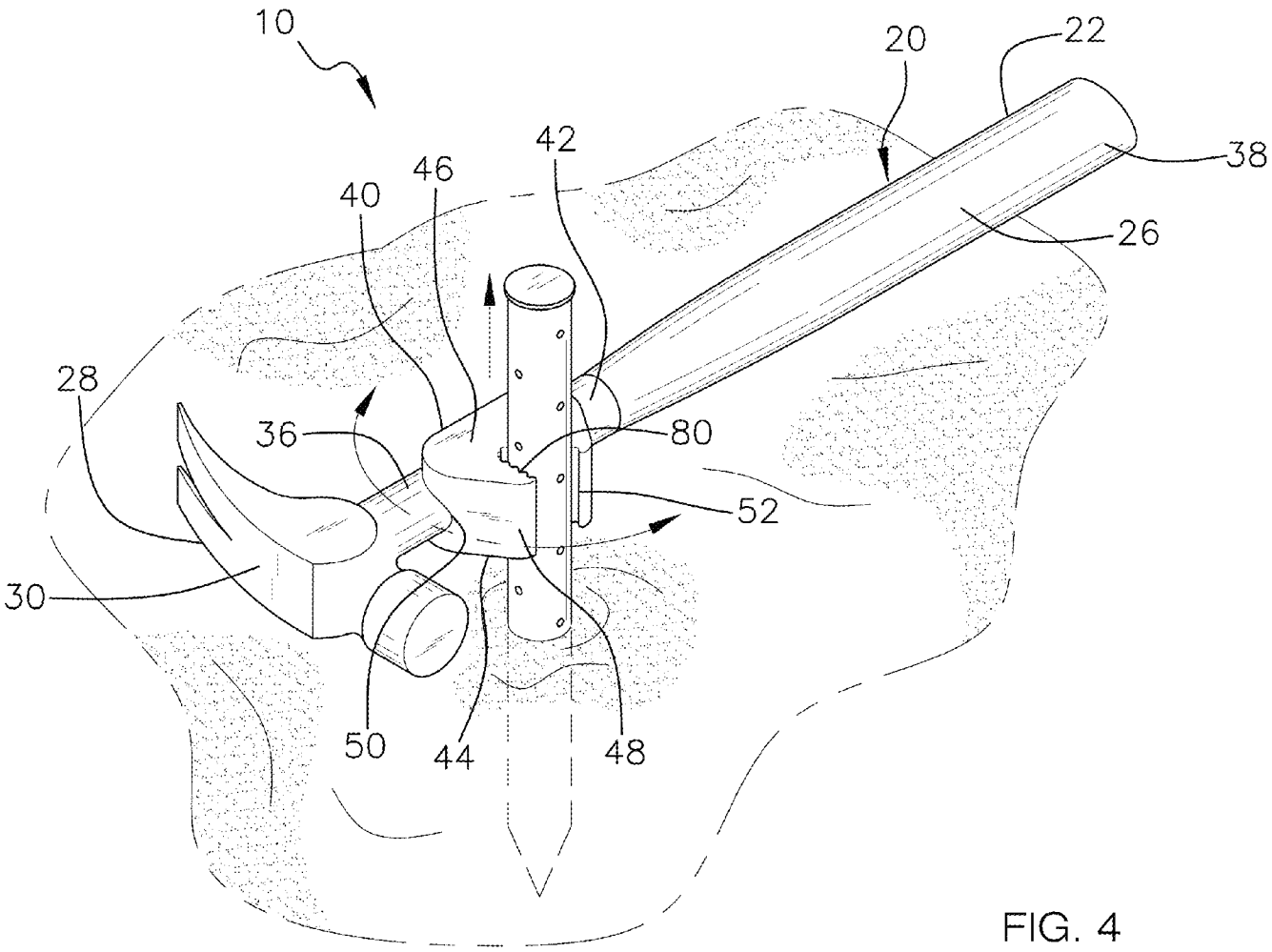
FIG. 4 is an in-use view showing the stake puller being used to extract a stake.
Figure 5:
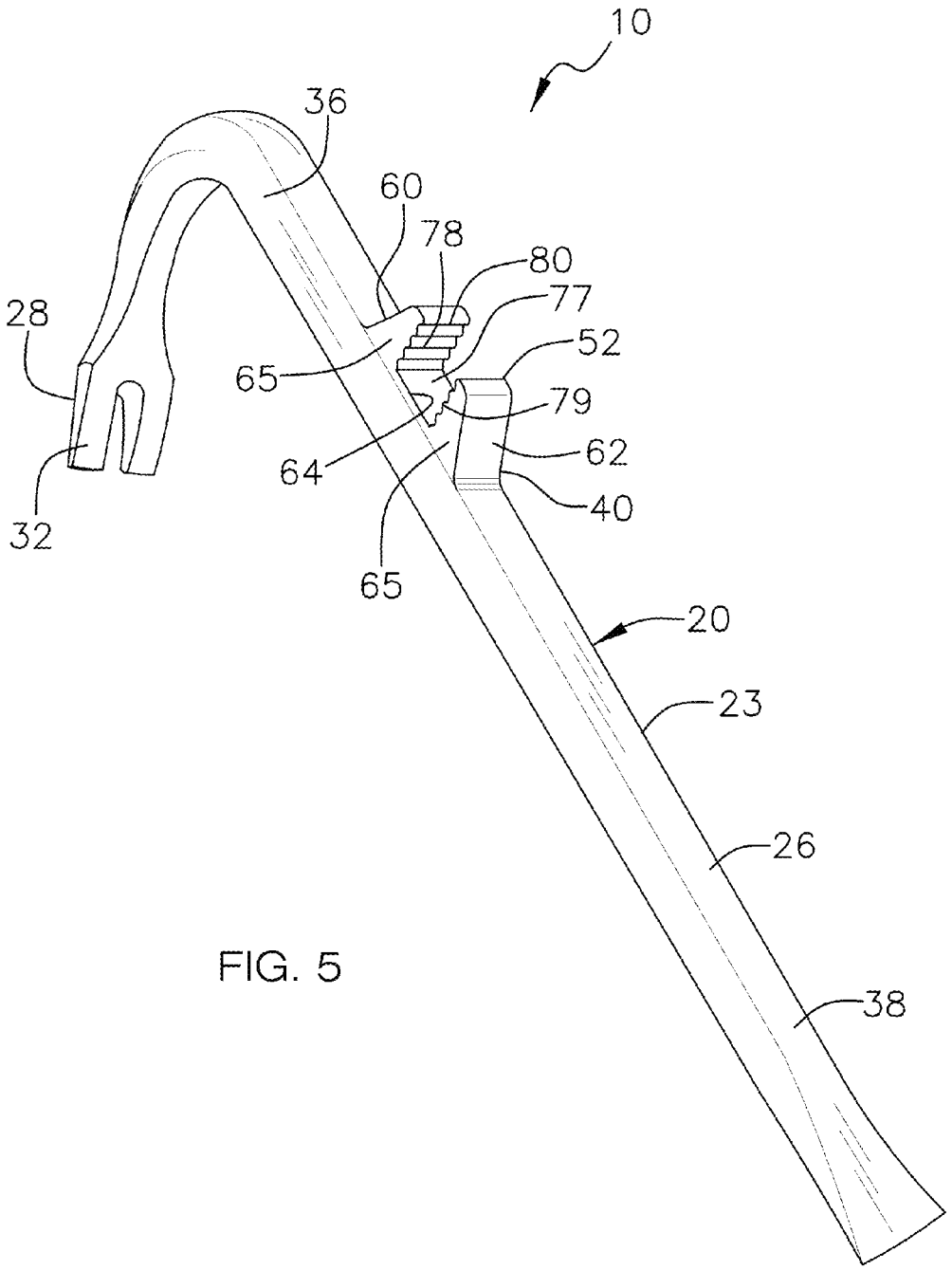
FIG. 5 is an isometric view showing the stake puller disposed on the tool implement in the form of a crow bar.
Figure 6:
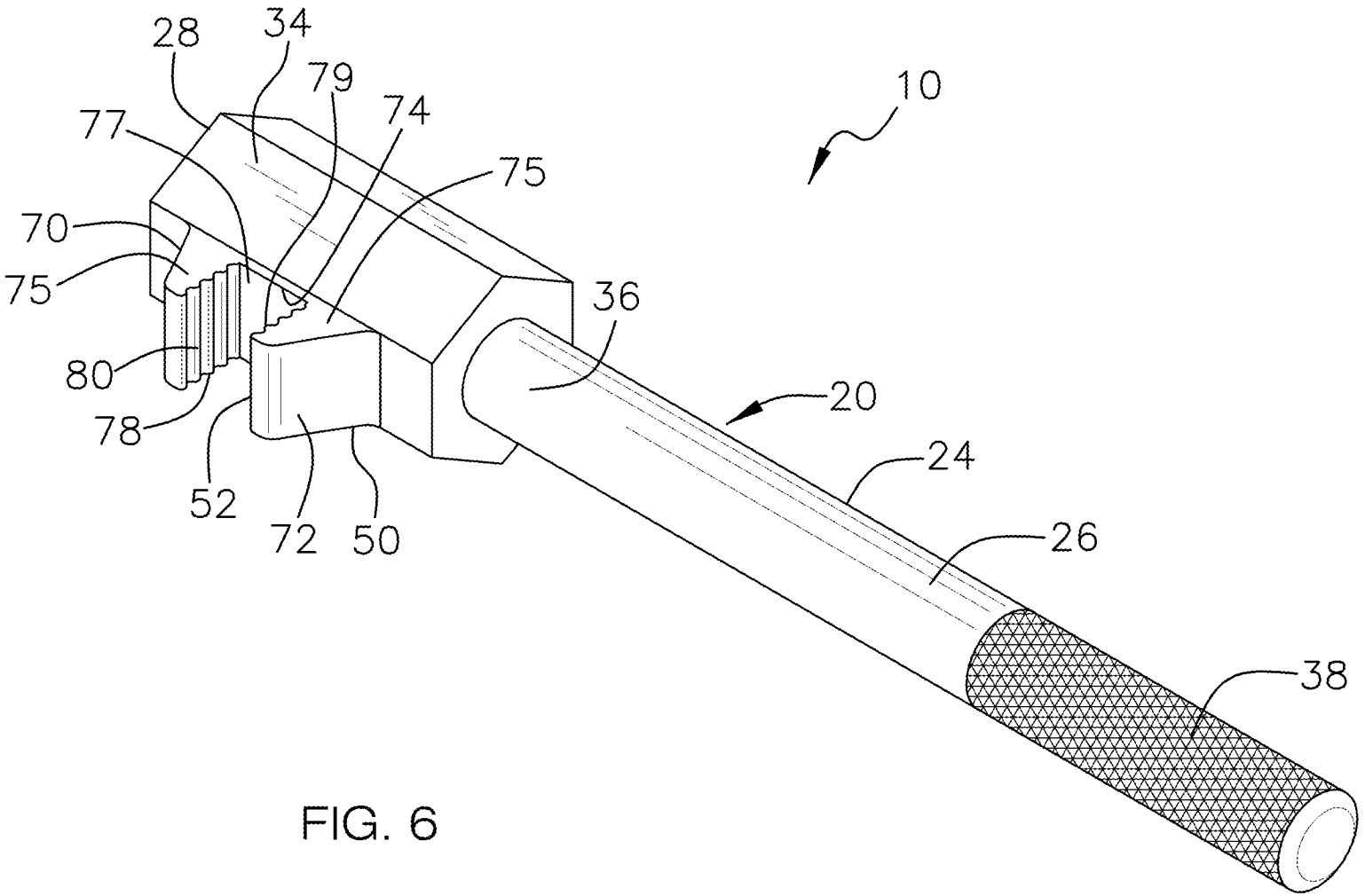
FIG. 6 is an isometric view showing the stake puller disposed on the tool implement in the form of a mallet.

FIGS. 1 through 6 illustrate the present tool implement with integrated stake puller 10 designed to provide a working tool as well as a structure for pulling a concrete foundation stake used to hold a wooden form in place prior to pouring concrete from the ground. The tool implement with integrated stake puller 10 includes a tool implement 20, such as a hammer 22, a crowbar 23, or a mallet 24. Each tool implement 20 includes a handle 26 and a tool head 28. The tool head 28 is one of a hammerhead 30 as shown in FIGS. 1 through 4, a head of a crowbar 32 as illustrated in FIG. 5, and a mallet head 34 as shown in FIG. 6, each of the tool head 28 attached to a respective tool implement 20. The handle 26 has a proximal end 36 and a grip end 38 opposite the proximal end 36. The tool head 28 is disposed on the proximal end 36 of the handle 26 of a respective tool implement 20.

A C-shaped stake puller member 40 is disposed in a first position on the handle 26 proximal the tool head 28, alternately in a second position on the handle 26 proximal the tool head 28, and further alternately in a third position on the tool head 28 itself. The stake puller member 40 is disposed in the respective one of the first, second, and third positions depending upon the type of tool head 28 disposed on the tool implement 20.

The stake puller member 40 is disposed in the first position wherein the tool head 28 is a hammerhead 30. The stake puller member 40 is disposed in the second position wherein the tool head 28 is a head of a crowbar 32. The stake puller member 40 is disposed in the third position wherein the tool head 28 is a mallet head 34.

The stake puller member 40 in the first position is centrally disposed in a neck 42 of the handle 26 and is perpendicular to the tool head 28 and on a same one of a front side 27 of the handle 26 as at least a portion of the tool head 28, which is a hammerhead having a strike contact surface 29 and a nail puller 31. In the first position, the stake puller member 40 has a continuous convex C-shaped outer wall 44 and a pair of diametrically opposed C-shaped side walls 46 that conform to the outer wall. The outer wall 44 has a top portion 48 and a bottom portion 49. The stake puller member 40 in the first position further has a U-shaped apex 50 of the top portion 48 of the outer wall 44 with the apex 50 conforming to a horizontal axis of the neck 42. The stake puller member 40 in the first position has a C-shaped toothed puller mouth 52 disposed therein in a position opposite to and conforming to the C-shaped outer wall 44.

The stake puller member 40 in the second position is integrally disposed on the handle 26 proximal the proximal end 36 on an opposite side of the handle 26 from the tool head 28. The C-shaped stake puller member 40 in the second position has a top wall 60 and a bottom wall 62 angled toward each other and an inner wall 64, which constitutes a portion of the handle 26 between the top wall 60 and the bottom wall 62. In the second position of the stake puller member 40, a pair of diametrically opposed triangular side edges 65 is disposed on each of a side of each of the top wall 60 and the bottom wall 62. In the second position, the stake puller member 40 includes a C-shaped puller mouth 52 defined by the inner wall 64, the top wall 60, the bottom wall 62 and the side edges 65.

The stake puller member 40 in the third position is integrally disposed on the tool head 28 and has an upper wall 70 and a lower wall 72 angled toward each other as well as an inside wall 74, which is a portion of the handle 26 between the upper wall 70 and the lower wall 72. A pair of diametrically opposed triangular outside walls 75 is disposed on each of a side of each of the upper wall 70 and the lower wall 72. A C-shaped toothed puller mouth 52 is defined by the inside wall 74, the upper wall 70, the lower wall 72, and the outside walls 75 of the stake puller member 40 in the third position.

The puller mouth 52 of each of the stake puller members 40 in a respective first, second and third position has a smooth-surfaced inner side 77 in a position parallel to the respective handle 26 and alternately tool head 28. The puller mouth 52 also has a concave top section 78 and a concave bottom section 79 disposed on opposite sides of the inner side 77. A plurality of ridges 80 is disposed on each of the top section 78 and the bottom section 79 in a position parallel to each other and perpendicular to the respective handle 26 and alternately tool head 28. The puller mouth 52 is configured and sized to securingly engage and remove a concrete foundation stake from a ground surface as shown in FIG. 4.

What is claimed is:

1. A tool implement with integrated stake puller comprising:

a tool implement comprising a handle and a tool head, the handle having a proximal end and a grip end opposite the proximal end, the tool head disposed on the proximal end of the handle of the tool implement, wherein the tool head is a hammerhead having a striking contact surface and a nail puller;

a C-shaped stake puller member disposed on the handle proximal the tool head;

the stake puller member being centrally disposed in a neck of the handle, in a position perpendicular to the handle and on a same one of a rear side of the handle as at least a portion of the tool head, the stake puller member having a continuous convex C-shaped outer wall, a pair of diametrically opposed C-shaped side walls, the outer wall having a top portion and a bottom portion, the stake puller member in the first position further having a U-shaped apex of the top portion of the outer wall, the apex conforming to a horizontal axis of the neck a smooth-surfaced inner side of the C-shaped puller mouth, the inner side being in a position parallel to the handle;

a concave top section and a concave bottom section of the puller mouth disposed on opposite sides of the inner side; and a plurality of ridges disposed on each of the top section and the bottom section in a position parallel to each other and perpendicular to the handle.

* * * * *